US010207524B2

(12) United States Patent
Aoki et al.

(10) Patent No.: US 10,207,524 B2
(45) Date of Patent: Feb. 19, 2019

(54) IMAGE RECORDING APPARATUS

(71) Applicant: BROTHER KOGYO KABUSHIKI KAISHA, Nagoya-shi, Aichi-ken (JP)

(72) Inventors: Hirotaka Aoki, Nagoya (JP); Kenji Samoto, Nagoya (JP); Takahiro Kuroki, Kuwana (JP)

(73) Assignee: BROTHER KOGYO KABUSHIKI KAISHA, Nagoya-Shi, Aichi-Ken (JP)

( * ) Notice: Subject to any disclaimer, the term of this patent is extended or adjusted under 35 U.S.C. 154(b) by 0 days.

(21) Appl. No.: 15/417,815

(22) Filed: Jan. 27, 2017

(65) Prior Publication Data

US 2017/0217224 A1 Aug. 3, 2017

(30) Foreign Application Priority Data

Jan. 29, 2016 (JP) ..... 2016-016033

(51) Int. Cl.
*B41J 29/38* (2006.01)
*B41J 13/00* (2006.01)

(52) U.S. Cl.
CPC ..... *B41J 13/0009* (2013.01)

(58) Field of Classification Search
None
See application file for complete search history.

(56) References Cited

U.S. PATENT DOCUMENTS 7,198,341 B1 * 4/2007 Rast ..... B41J 3/4071 345/179
2004/0089996 A1 * 5/2004 Asada ..... B65H 7/18 271/110
2011/0210996 A1 * 9/2011 Itogawa ..... B41J 11/0015 347/9
2011/0310145 A1 * 12/2011 Samoto ..... B41J 11/0095 347/9
2012/0319345 A1 * 12/2012 Asada ..... B41J 13/0018 271/3.2
2013/0257962 A1 * 10/2013 Oguchi ..... B41J 13/0009 347/16

(Continued)

FOREIGN PATENT DOCUMENTS

JP 2000-343762 A 12/2000
JP 2002-073300 A 3/2002

*Primary Examiner* — Matthew Luu
*Assistant Examiner* — Tracey McMillion
(74) *Attorney, Agent, or Firm* — Merchant & Gould P.C.

(57) ABSTRACT

An image recording apparatus includes a first motor, a feeding roller, a second motor, a first driven mechanism, a recorder, and a controller. The feeding roller is configured to rotate by receiving driving force from the first motor. The first driven mechanism is configured to be driven by receiving driving force from the second motor. The controller is configured to: perform a preparing operation in response to receiving first information that instructs starting image recording by the recorder; perform a driving operation of driving the second motor to drive the first driven mechanism, in response to completing the preparing operation and not receiving second information including a recording condition and printing data; and in response to receiving the second information, stop the second motor and drive the first motor to perform a feeding operation by the feeding roller.

13 Claims, 10 Drawing Sheets

(56) References Cited

U.S. PATENT DOCUMENTS

2013/0285316 A1* 10/2013 Deno ..... B65H 7/00
271/229
2014/0292852 A1* 10/2014 Numata ..... B41J 2/04556
347/9
2014/0320876 A1* 10/2014 Ikebata ..... H04N 1/00278
358/1.13

* cited by examiner

IMAGE RECORDING APPARATUS

CROSS REFERENCE TO RELATED APPLICATIONS

This application claims priority from Japanese Patent Application No. 2016-016033 filed Jan. 29, 2016. The entire content of the priority application is incorporated herein by reference.

TECHNICAL FIELD

This disclosure relates to an image recording apparatus configured to record an image on a sheet.

BACKGROUND

An image recording apparatus has been required to shorten its preprocessing time counted from reception of a user's instruction for image recording on a sheet to completion of actual image recording on the sheet. For example, in a recording system, an information processing apparatus transmits, to a recording apparatus, first data instructing start of a preparing operation performed before the recording apparatus performs the recording operation, and then transmits second data based on information to be recorded to the recording apparatus. Since the preparing operation is performed in advance, the preprocessing time is shortened.

In addition, in order to alleviate a user's uneasiness caused by a fact that an image recording apparatus does not operate during preprocessing time, a means to play melody during the preprocessing time is proposed.

SUMMARY

According to one aspect, this specification discloses an image recording apparatus. The image recording apparatus includes a first motor, a feeding roller, a second motor, a first driven mechanism, a recorder, and a controller. The feeding roller is configured to rotate by receiving driving force from the first motor. The first driven mechanism is configured to be driven by receiving driving force from the second motor. The controller is configured to: perform a preparing operation in response to receiving first information that instructs starting image recording by the recorder; perform a driving operation of driving the second motor to drive the first driven mechanism, in response to completing the preparing operation and not receiving second information including a recording condition and printing data; and in response to receiving the second information, stop the second motor and drive the first motor to perform a feeding operation by the feeding roller.

BRIEF DESCRIPTION OF THE DRAWINGS

Embodiments in accordance with this disclosure will be described in detail with reference to the following figures wherein:

FIGS. 6A to 6C are schematic diagrams showing a switching mechanism 170, wherein FIG. 6A shows a first driving state, FIG. 6B shows a second driving state, and FIG. 6C shows a third driving state;

FIGS. 7A to 7C are plan views of a lever 177 and the guide rail 43, wherein FIG. 7A shows a state in which a sliding member 171 takes a position A, FIG. 7B shows a state in which the sliding member 171 takes a position B, and FIG. 7C shows a state in which the sliding member 171 takes a position C;

DETAILED DESCRIPTION

However, the user who has instructed the image recording apparatus to perform image recording often does not understand the reason why the melody that is not ordered played. As a result, it becomes hard for the user to determine whether the image recording apparatus operates based on the user's instructions or the image recording apparatus plays melody based on some other instructions. Consequently, the user cannot completely wipe out their uneasiness or another uneasiness is caused.

Accordingly, an example of an object of this disclosure is to provide an image recording apparatus that alleviates a user's uneasiness during preprocessing time.

Hereinafter, an image recording apparatus according to some aspects of this disclosure will be described while referring to the accompanying drawings. In the following description, an upper-lower direction Z is defined by a state where the MFP 10 is disposed in an orientation in which it is intended to be used (the state of FIG. 1); a front-rear direction Y is defined such that the face having an opening 13 is the front face; and a left-right direction X is defined as viewed from the front of the MFP 10.

[Overall configuration of MFP 10]

Figure 1:
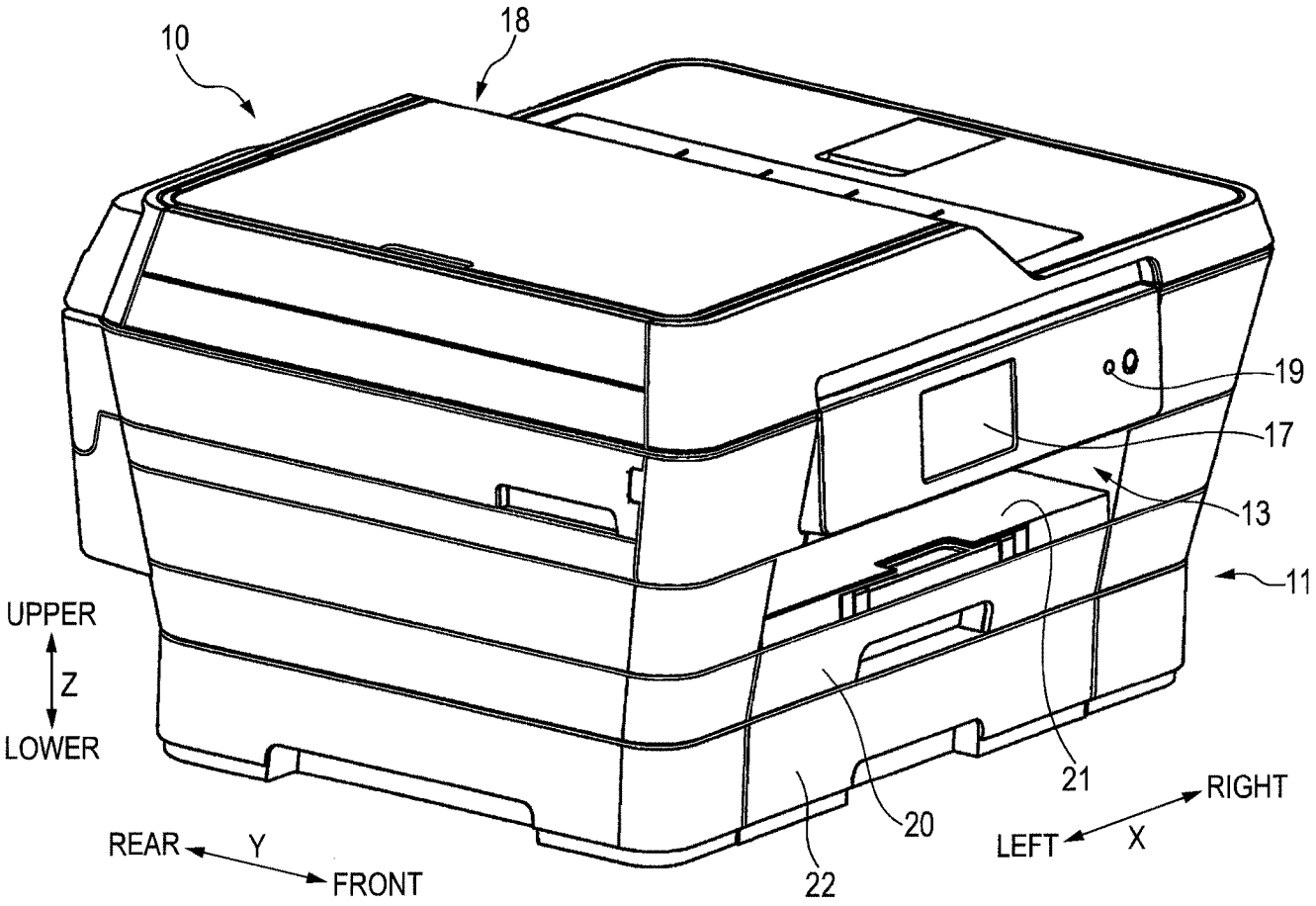
FIG. 1 is a perspective view of a multifunction peripheral (MFP) 10.

As shown in FIG. 1, the MFP 10 (an example of an image recording apparatus) is made in a substantially rectangular parallelepiped shape. The MFP 10 has various functions such as facsimile function and printing function. The MFP 10 has a printer 11 in the lower part thereof for recording an image on a sheet 12 (refer to FIG. 2) by an inkjet recording method. The MFP 10 has a scanner 18 in the upper part thereof. The scanner 18 is a flatbed scanner having, for example, an automatic document feeder at an original document cover. The MFP 10 has an operation panel 17 in the front face thereof. The operation panel 17 has a power switch, a touch panel for receiving an input by a user and for displaying images, and an LED lamp 19. The lamp 19 is switched on and off in conjunction with the ON/OFF of the power source.

Figure 2:
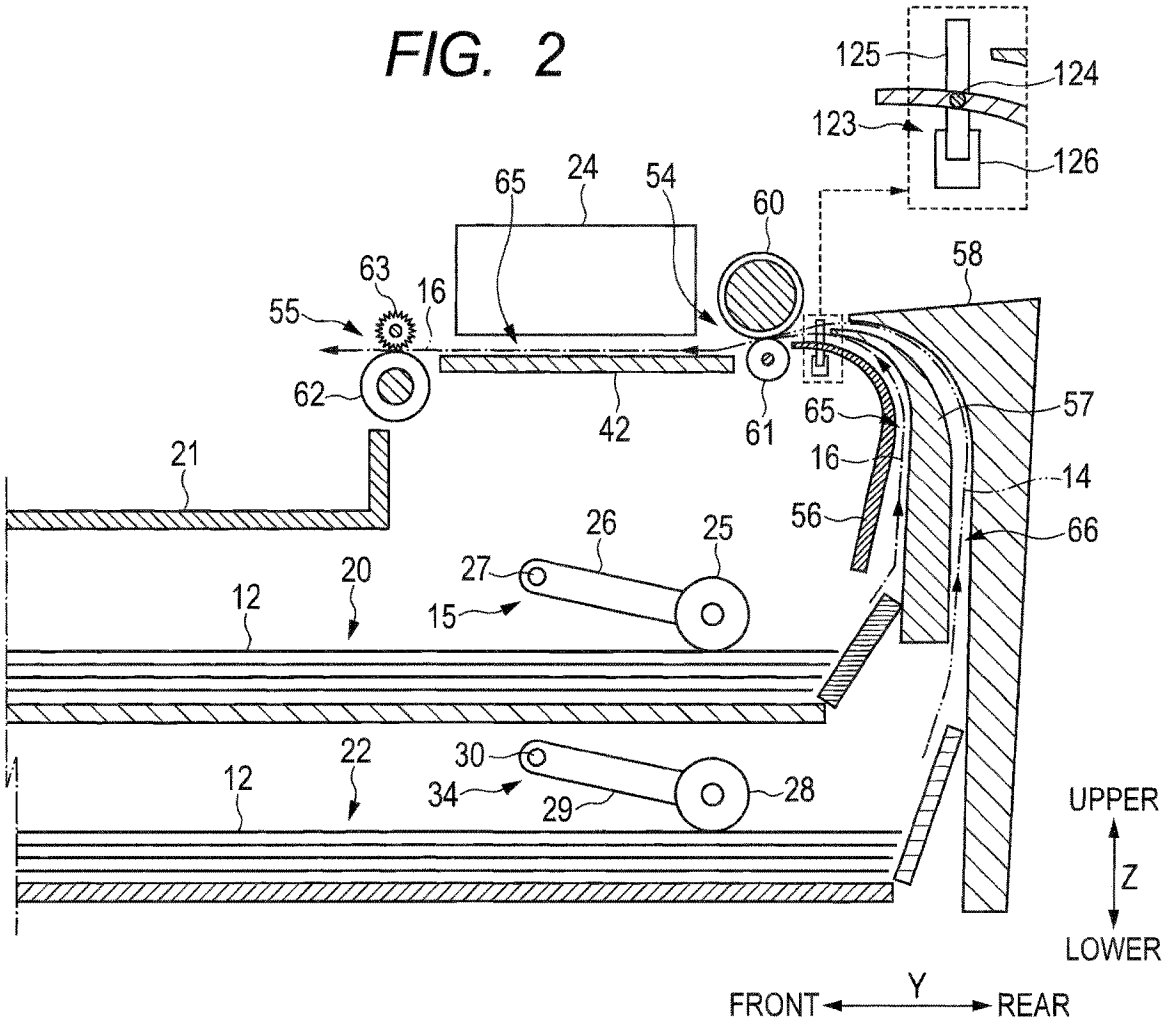
FIG. 2 is a vertical cross-sectional view schematically illustrating an internal structure of a printer 11.

As shown in FIG. 2, the printer 11 includes a first feeding tray 20, a second feeding tray 22, a first feeding section 15, a second feeding section 34, a discharging tray 21, a conveying section 54, a paper discharging section 55, a recording section 24, and a platen 42.

Figure 3:
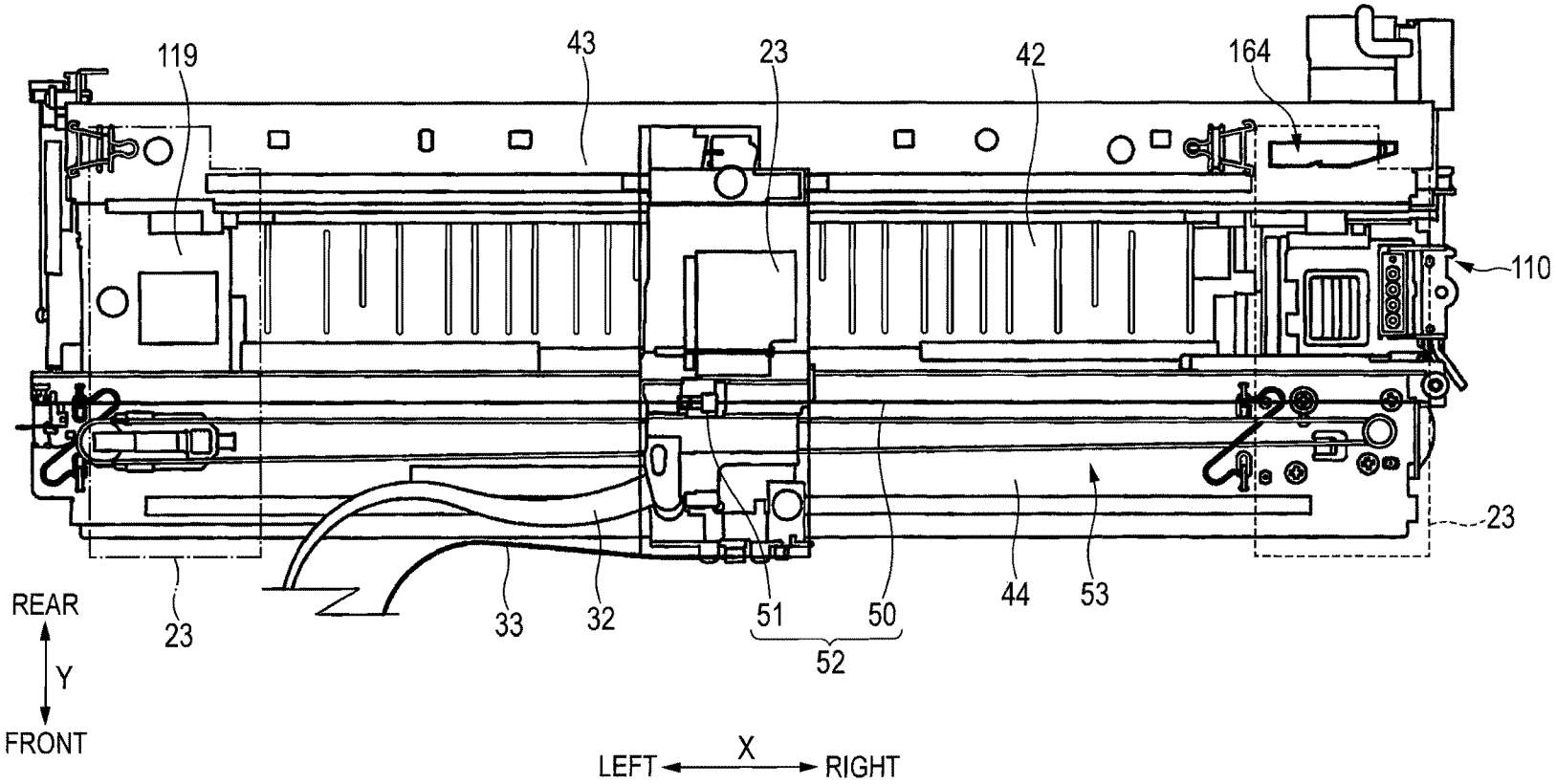
FIG. 3 is a plan view of a carriage 23 and guide rails 43, 44.
Figure 4:
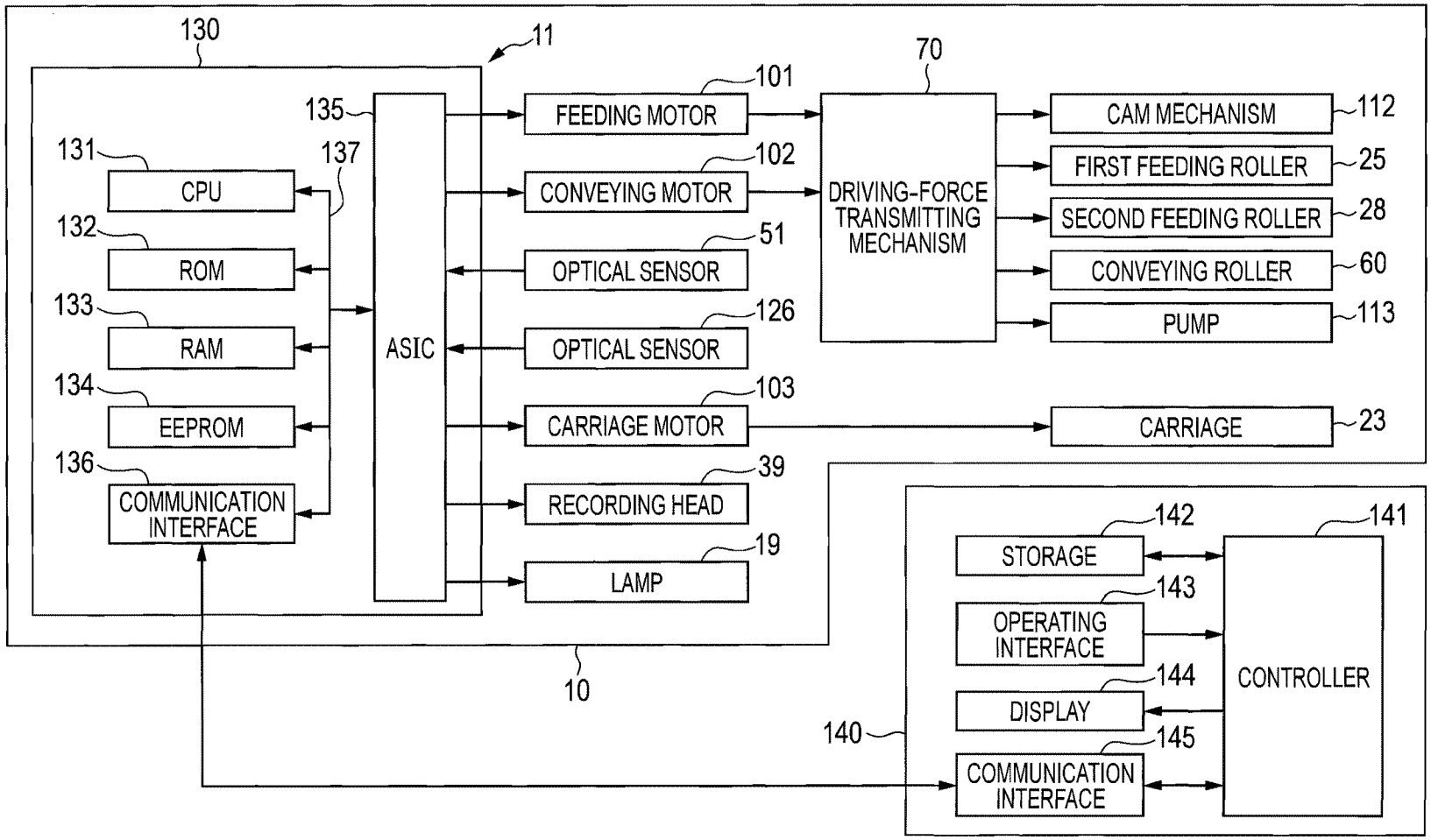
FIG. 4 is a block diagram of the MFP 10 and an information processing apparatus 140.

As shown in FIGS. 3 and 4, the printer 11 also includes a feeding motor 101 (an example of a first motor), a conveying motor 102 (an example of a second motor), a carriage motor 103, a controller 130, a driving force transmitting mechanism 70, and a maintenance mechanism 110 (an example of a second driven mechanism).

[First Feeding Tray 20, Discharging Tray 21, and Second Feeding Tray 22]

As shown in FIGS. 1 and 2, the first feeding tray 20 and the second feeding tray 22 are inserted rearward into the printer 11 through the opening 13, and these trays are withdrawn forward out of the printer 11 through the opening 13. The first feeding tray 20 and the second feeding tray 22 are set in upper and lower two stages when inserted in the printer 11. The first feeding tray 20 is provided above the second feeding tray 22. Each of the first feeding tray 20 and the second feeding tray 22 supports a plurality of stacked sheets 12.

The discharging tray 21 is located above the first feeding tray 20. The discharging tray 21 supports the sheets 12 discharged by the paper discharging section 55.

[First Feeding Section 15 and Second Feeding Section 34]

The first feeding section 15 is provided for the first feeding tray 20, and the second feeding section 34 is provided for the second feeding tray 22.

As shown in FIG. 2, the first feeding section 15 has a first feeding roller 25, a first feeding arm 26, and a first shaft 27. The first feeding roller 25 is rotatably supported by an end of the first feeding arm 26. The first feeding roller 25 is forwardly rotated, by forward rotation of the feeding motor 101 (refer to FIG. 4), in a direction to convey the sheet 12 supported by the first feeding tray 20 toward a below-described first conveying path 65 in a conveying direction 16 (that is, a forward rotation). The first feeding arm 26 is rotatably supported by the first shaft 27 supported by a frame (not shown) of the printer 11.

The second feeding section 34 has a second feeding roller 28, a second feeding arm 29, and a second shaft 30. The second feeding roller 28 is rotatably supported by an end of the second feeding arm 29. The second feeding roller 28 is forwardly rotated, by forward rotation of the feeding motor 101 (refer to FIG. 4), in a direction to convey the sheet 12 supported by the second feeding tray 22 toward a below-described second conveying path 66 in a conveying direction 14 (that is, a forward rotation). The second feeding arm 29 is rotatably supported by a second shaft 30 supported by the frame (not shown) of the printer 11.

Transmission of driving force from the feeding motor 101 to both the first feeding roller 25 and the second feeding roller 28 will be described later in detail.

[First Conveying Path 65 and Second Conveying Path 66]

As shown in FIG. 2, the first conveying path 65 and the second conveying path 66 are formed inside the printer 11 in order for the sheet 12 to pass through.

The first conveying path 65 is a space defined by the first guide member 56 and the second guide member 57 facing each other with a predetermined gap therebetween inside the printer 11, the conveying section 54, the recording section 24, the platen 42, and the paper discharging section 55. The conveying direction 16 of the sheet 12 in the first conveying path 65 is shown by a single-dot chain line arrow in FIG. 2.

The second conveying path 66 is a space defined by the second guide member 57 and the third guide member 58 facing each other with a predetermined gap therebetween inside the printer 11. The second conveying path 66 is formed at the rear of the first conveying path 65. The second conveying path 66 joins the first conveying path 65 at the upstream side of the conveying section 54 in the conveying direction 16. The conveying direction 14 of the sheet 12 in the second conveying path 66 is shown by a double-dot chain line arrow in FIG. 2.

[Conveying Section 54]

As shown in FIG. 2, the conveying section 54 is arranged at the upstream side of the recording section 24 in the first conveying path 65 in the conveying direction 16. The conveying section 54 has a conveying roller 60 (an example of first conveying roller) and a pinch roller 61 facing each other. The conveying roller 60 rotates when driving force from a conveying motor 102 (refer to FIG. 4) is transmitted thereto. The pinch roller 61 rotates in conjunction with the rotation of the conveying roller 60. The conveying section 54 forwardly rotates when forward driving force of a conveying motor 102 is transmitted thereto. The forward rotation is a rotation to convey the nipped sheet 12 in the conveying direction 16.

[Paper Discharging Section 55]

As shown in FIG. 2, the paper discharging section 55 is formed downstream of the recording section 24 in the first conveying path 65 in the conveying direction 16. The paper discharging section 55 has a discharging roller 62 (an example of second conveying roller) and a spur 63 facing each other. The discharging roller 62 rotates when driving force from the conveying motor 102 (refer to FIG. 4) is transmitted thereto through an endless belt wound around the discharging roller 62 and the conveying roller 60. The spur 63 rotates by the rotation of the discharging roller 62. The paper discharging section 55 forwardly rotates when forward driving force of the conveying motor 102 is transmitted thereto. The forward rotation is a rotation to convey the nipped sheet 12 in the conveying direction 16.

[Recording Section 24]

As shown in FIG. 2, the recording section 24 is arranged between the conveying section 54 and the paper discharging section 55 in the first conveying path 65. The recording section 24 is arranged to face the platen 42 from above. The recording section 24 has a carriage 23 and a recording head 39. As shown in FIG. 3, an ink tube 32 and a flexible flat cable 33 are extended from the carriage 23. The ink tube 32 supplies ink reserved in an ink cartridge to the recording head 39 (refer to FIG. 2). The flexible flat cable 33 electrically connects the recording head 39 and a control board (not shown) on which the controller 130 is mounted.

The carriage 23 is supported by guide rails 43, 44 which are arranged separately in the front-rear direction Y and extend in the left-right direction X. The carriage 23 is connected to a known belt mechanism 53 provided on the guide rail 44. The belt mechanism 53 is driven by the carriage motor 103 (refer to FIG. 4). The belt mechanism 53 circularly moves by the driving of the carriage motor 103. The carriage 23 connected to the belt mechanism 53 reciprocates in the left-right direction X.

Figure 5:
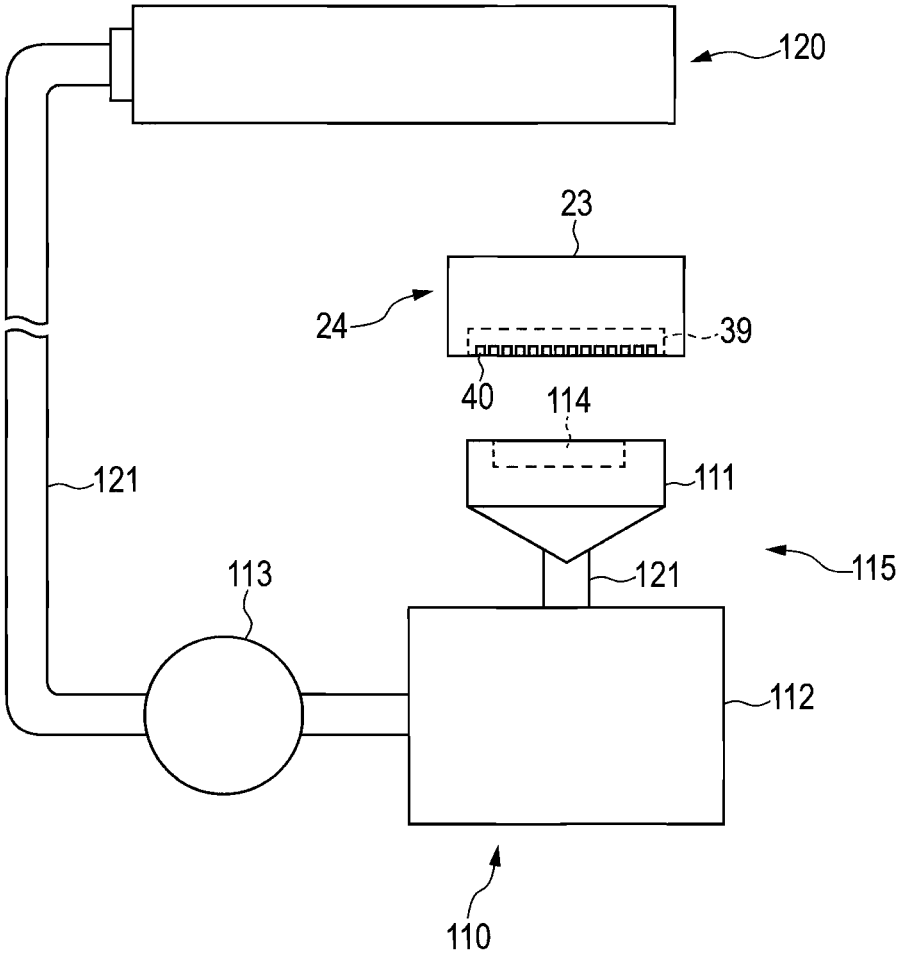
FIG. 5 is a schematic view illustrating a configuration of a maintenance mechanism 110 and a waste ink tank 120.

As shown in FIG. 5, the recording head 39 is mounted on the carriage 23. In the lower face of the recording head 39, a plurality of nozzles 40 are formed. The recording head 39 selectively ejects ink from the nozzles 40 in the form of micro droplets of ink. During the reciprocating movement of the carriage 23, the recording head 39 ejects the ink droplets. Accordingly, ink droplets are deposited on the sheet 12 that is conveyed by the conveying section 54 and supported by the platen 42, and thereby an image is recorded on the sheet 12.

During the image recording on the sheet 12, the carriage 23 reciprocates in the left-right direction X within the range where the recording head 39 is configured to eject ink droplets on the sheet 12. More specifically, the carriage 23 reciprocates in the region where the recording head 39 faces the first conveying path 65 from above. Hereinafter, the region in which the carriage 23 reciprocates during the image recording is referred to as a "first region".

The carriage 23 is configured to move not only in the first region but also in a "second region" which is located on the right side from the first conveying path 65 and in a "third region" which is located on the left side from the first region and the first conveying path 65. The carriage 23 located in the second region is shown by a dashed line in FIG. 3. The carriage 23 located in the third region is shown by a single-dot chain line in FIG. 3.

The first region is a region where the carriage 23 is located when an image is recorded on the sheet 12 by the recording head 39. The second region is a region where the carriage 23 is located when maintenance of the recording head 39 is performed. Maintenance of the recording head 39 will be described later. The third region is a region where the carriage 23 is located when a flushing process is performed by the recording head 39. The flushing process will be described later.

[Platen 42]

As shown in FIG. 2, the platen 42 is arranged between the conveying section 54 and the paper discharging section 55 in the conveying direction 16. The platen 42 is arranged to face the recording section 24 from below, and supports, from below, the sheet 12 conveyed by the conveying section 54.

[Linear Encoder 52]

As shown in FIG. 3, the guide rail 44 has an encoder strip 50. The encoder strip 50 is a transparent resin-made belt. The encoder strip 50 is bridged in the left-right direction X by engaging the right end and the left end of the encoder strip 50 to respective supporting ribs (not shown).

The encoder strip 50 has a pattern in which translucent parts that transmit light and blocking parts that block light are arranged alternately at regular intervals in the longitudinal direction. At a position in the carriage 23 corresponding to the encoder strip 50, an optical sensor 51 of a transmission type is provided. With the encoder strip 50 and the optical sensor 51, a linear encoder 52 is formed for detecting the position of the carriage 23. Signals detected by the optical sensor 51 are outputted to the below-described controller 130 (refer to FIG.

4).

[Detector 123]

As shown in FIG. 2, the detector 123 is arranged at the upstream side of the conveying section 54 in the first conveying path 65 in the conveying direction 16. The detector 123 has a shaft 124, a detection element 125 which is configured to pivotally moves about the shaft 124, and an optical sensor 126 which has a light emitting element and a light receiving element that receives light emitted from the light emitting element.

One end of the detection element 125 protrudes toward the first conveying path 65. When external force is not applied to the one end of the detection element 125, the other end of the detection element 125 enters an optical path extending from the light emitting element of the optical sensor 126 to the light receiving element; that result in interruption of the light passing through the optical path. At this time, a low-level signal is outputted from the optical sensor 126 to the controller 130 (refer to FIG. 4).

When the one end of the detection element 125 is pushed by the leading end of the sheet 12 and pivotally moves, the other end of the detection element 125 comes out of the optical path, thereby the light passes through the optical path. At this time, a high-level signal is outputted from the optical sensor 126 to the controller 130. The controller 130 detects a downstream end and an upstream end of the sheet 12 in the conveying direction 16 based on the signals outputted from the optical sensor 126.

[Maintenance Mechanism 110 and Waste Ink Tank 120]

The maintenance mechanism 110 shown in FIG. 5 is used for maintenance of the recording head 39. More precisely, the maintenance mechanism 110 performs purging by sucking ink and air remaining in the nozzles 40 and foreign matters adheres on the surface of the nozzles (that is, the face of the recording head 39 where the nozzles 40 are formed) (hereinafter, ink, air, and the foreign matters are collectively referred to as "ink or the like"). The maintenance mechanism 110 sucks ink from the nozzles 40 of the recording head 39 and then sends the sucked ink to the waste ink tank 120 through a tube 121. The maintenance mechanism 110 is arranged below the carriage 23 located in the second region.

The waste ink tank 120 is arranged below the moving path of the carriage 23. In the waste ink tank 120, an ink absorber (not shown) is housed. The waste ink tank 120 is configured to store ink or the like sucked from the nozzles 40 by the ink absorber that absorbs the ink. Note that, in FIG. 5, the waste ink tank 120 is schematically shown in order to indicate that the maintenance mechanism 110 and the waste ink tank 120 are connected with each other by the tube 121; however it does not show the positional relation of the waste ink tank 120 with other components.

The maintenance mechanism 110 includes a capping mechanism 115 having a movable part 111 and a cam mechanism 112 that enables the movable part 111 to move in the upper-lower direction Z, a tube 121 through which ink passes, and a pump 113 for sucking ink.

The movable part 111 has a cap 114 made of rubber material. The cap 114 is arranged to face, from below, the carriage 23 located at the right side from the first region (that is, at the second region). More specifically, the cap 114 is arranged to face, from below, the plurality of nozzles 40 provided in the lower face of the recording head 39. The cam mechanism 112 is driven by a feeding motor 101 (refer to FIG. 4) and moves the movable part 111 in the upper-lower direction Z. By the driving force transmitted from the feeding motor 101, the cap 114 moves between a separated position being separated from the nozzles 40 (an example of the second position) and a covered position where the cap 114 contacts the lower surface of the recording head 39 to cover the nozzles 40 (an example of the first position). When the movable part 111 is moved upward, the cap 114 contacts the lower face of the recording head 39 mounted on the carriage 23 located in the second region. At this time, the cap 114 covers the nozzles 40. When the movable part 111 is moved downward, the cap 114 separates from the nozzles 40.

The cap 114 is connected to one end of the tube 121. The tube 121 is a flexible resin-made tube. The other end of the tube 121 is connected to the waste ink tank 120.

The pump 113 (an example of the second driven mechanism) is a rotary tube pump, for example. By the driving force transmitted from the conveying motor 102 (refer to FIG. 4), the pump 113 sucks ink or the like remaining inside the nozzles 40 through the cap 114 and the tube 121 and then ejects the sucked ink or the like to the waste ink tank 120 through the tube 121.

[Ink Receiving Section 119]

As shown in FIG. 3, an ink receiving section 119 is arranged below the moving path of the carriage 23 and at the left side from the left end of the platen 42. The ink receiving section 119 is arranged at a position directly below the carriage 23 located in the third region. The ink receiving section 119 is a substantially rectangular-parallelepiped box shape whose upper portion is open. The ink receiving section 119 houses an ink absorber (not shown). The ink receiving section 119 receives, from above, ejection of ink or the like from the recording head 39, which is so-called "flushing process". The ink or the like ejected from the recording head 39 is absorbed and held in the ink absorber.

[Driving Force Transmitting Mechanism 70]

As shown in FIG. 4, the printer 11 further includes a driving force transmitting mechanism 70. The driving force transmitting mechanism 70 transmits the driving force of the feeding motor 101 and the conveying motor 102 to the first feeding roller 25, the conveying roller 60, the discharging roller 62, the cam mechanism 112, and the pump 113. The driving force transmitting mechanism 70 is constituted by combining a part of or all of a gear, a pulley, an endless loop belt, a planetary gear mechanism (pendulum gear mechanism), a one-way clutch, and the like. Moreover, the driving force transmitting mechanism 70 includes a switching mechanism 170 (refer to FIG. 6) that selectively switches the transmission destination of the driving force from the feeding motor 101 and the conveying motor 102.

[Switching Mechanism 170]

The switching mechanism 170 is configured to switch the driving state among a first driving state, a second driving state, and a third driving state. The first driving state is a state where transmission destination of the conveying motor 102 is the conveying roller 60, the discharging roller 62, and the pump 113; and also transmission destination of the feeding motor 101 is the cam mechanism 112. The second driving state is a state where driving force of the conveying motor 102 is transmitted to the conveying roller 60 and the discharging roller 62 but not transmitted to the pump 113; and where transmission destination of the feeding motor 101 is the second feeding roller 28. The third driving state is a state where driving force of the conveying motor 102 is transmitted to the conveying roller 60 and the discharging roller 62 but not transmitted to the pump 113; and where transmission destination of the feeding motor 101 is the first feeding roller 25.

Figure 6A:
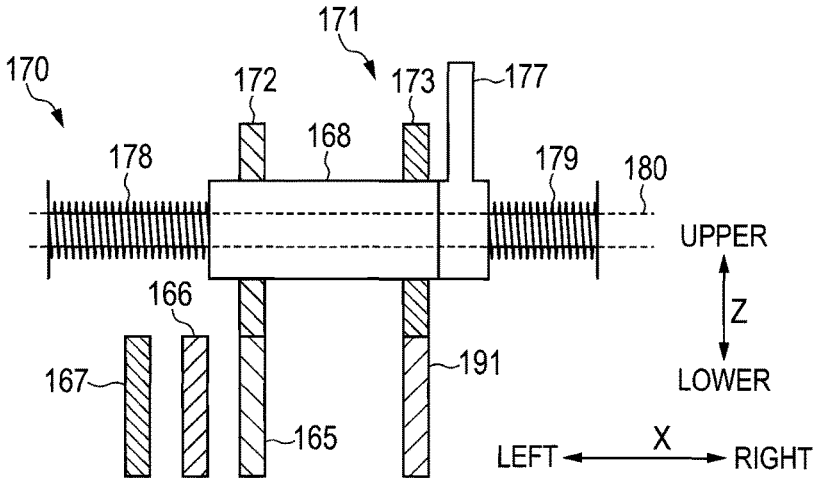
Figure 6B:
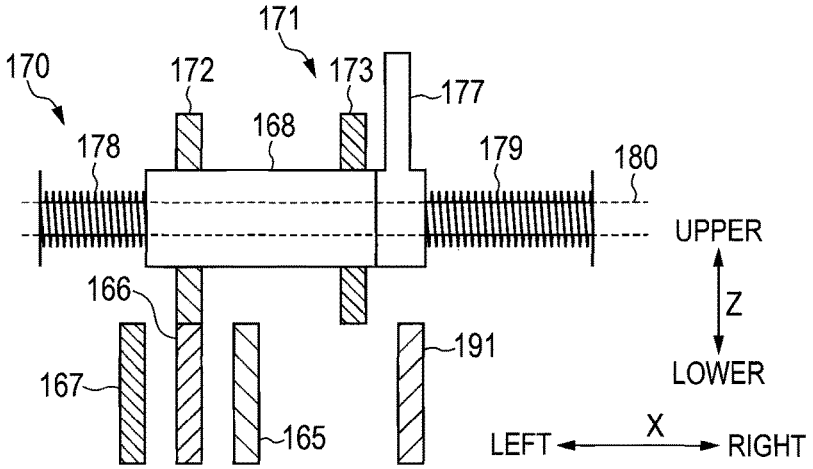
Figure 6C:
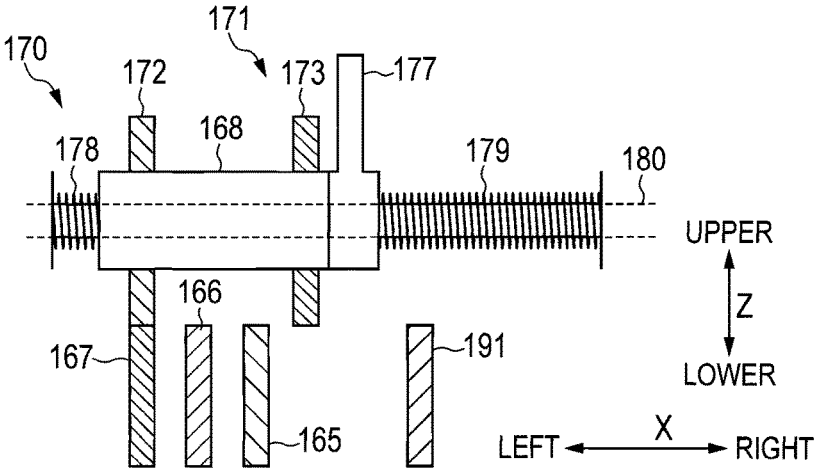

The switching mechanism 170 is arranged directly below the carriage 23 located in the second region. As shown in FIGS. 6A to 6C, the switching mechanism 170 mainly includes a sliding member 171 having a main body 168 and a lever 177, drive gears 172, 173, driven gears 165, 166, 167, 191, springs 178, 179, and a supporting shaft 180.

The main body 168 of the sliding member 171 is a substantially cylindrical member supported by the supporting shaft 180 extending in the left-right direction X. The main body 168 is configured to slidably move in the left-right direction X along the supporting shaft 180. Moreover, the main body 168 supports the drive gears 172, 173 in a shifted position in the left-right direction X on the outer face of the main body 168 in a manner where the respective drive gears 172, 173 are configured to rotating independently. In other words, the main body 168 and the drive gears 172, 173 slide integrally in the left-right direction X.

The drive gear 172 rotates by rotary driving force transmitted from the feeding motor 101. The drive gear 172 selectively engages with one of the driven gears 165, 166, and 167. More specifically, as shown in FIG. 6A, the drive gear 172 engages with the driven gear 165 when the switching mechanism 170 is in the first driving state. Moreover, as shown in FIG. 6B, the drive gear 172 engages with the driven gear 166 when the switching mechanism 170 is in the second driving state. Finally, as shown in FIG. 6C, the drive gear 172 engages with the driven gear 167 when the switching mechanism 170 is in the third driving state.

The drive gear 173 rotates by the rotary driving force transmitted from the conveying motor 102. As shown in FIG. 6A, the drive gear 173 engages with the driven gear 191 when the switching mechanism 170 is in the first driving state. Moreover, as shown in FIGS. 6B and 6C, the drive gear 173 does not engage with the driven gear 191 when the switching mechanism 170 is in the second and third driving states.

The driven gear 165 engages with a gear train for driving the cam mechanism 112. In other words, the rotary driving force of the feeding motor 101 is transmitted to the cam mechanism 112 by the engagement between the drive gear 172 and the driven gear 165 and then moves the cap 114 up and down, while the rotary driving force of the feeding motor 101 is not transmitted to the cam mechanism 112 by the disengagement between the drive gear 172 and the driven gear 165.

The driven gear 166 engages with a gear train for rotating the second feeding roller 28. In other words, the rotary driving force of the feeding motor 101 rotates the second feeding roller 28 by the engagement between the drive gear 172 and the driven gear 166, but is not transmitted to the second feeding roller 28 by the disengagement between the drive gear 172 and the driven gear 166.

The driven gear 167 engages with a gear train for rotating the first feeding roller 25. In other words, the rotary driving force of the feeding motor 101 rotates the first feeding roller 25 by the engagement between the drive gear 172 and the driven gear 167, but is not transmitted to the first feeding roller 25 by the disengagement between the drive gear 172 and the driven gear 167.

The driven gear 191 engages with a gear train for driving the pump 113. In other words, the rotary driving force of the conveying motor 102 drives the pump 113 by the engagement between the drive gear 173 and the driven gear 191, but is not transmitted to the pump 113 by the disengagement between the drive gear 173 and the driven gear 191.

On the other hand, the rotary driving force of the conveying motor 102 is transmitted to the conveying roller 60 and the discharging roller 62 without passing through the switching mechanism 170. In other words, the conveying roller 60 and the discharging roller 62 are driven by the rotary driving force of the conveying motor 102 regardless of the driving state of the switching mechanism 170.

The lever 177 of the sliding member 171 is supported by the supporting shaft 180 at a position adjacent to the right side of the main body 168. The lever 177 is provided slidably in the left-right direction X along the supporting shaft 180. In addition, the lever 177 protrudes upward. The tip of the lever 177 reaches a position at which the tip can contact the carriage 23 through an opening 164 (refer to FIG. 3) formed in the guide rail 43.

The springs 178, 179 are supported by the supporting shaft 180. Regarding the spring 178, the left end of the spring 178 contacts the frame of the printer 11, and the right end of the spring 178 contacts the left-end face of the main body 168 of the sliding member 171. In other words, the spring 178 urges the main body 168 and the lever 177 of the sliding member 171 contacting the main body 168 rightward. Regarding the spring 179, the right end of the spring 179 contacts the frame of the printer 11, and the left end of the spring 179 contacts the right-end face of the lever 177. In other words, the spring 179 urges the lever 177 and the main body 168 contacting the lever 177 toward the left. Moreover, the urging force of the spring 179 is set larger than that of the spring 178. Further, the spring 179 urges the lever 177 in the circumferential direction of the supporting shaft 180, specifically, in the rotating direction that the lever 177 moves forward.

Figure 7A:
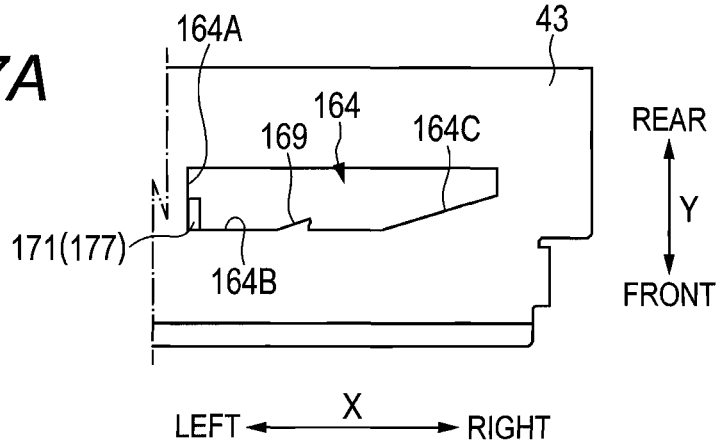

When the carriage 23 separates from the lever 177, the switching mechanism 170 is in the third driving state shown in FIG. 6C. At this time, as shown in FIG. 7A, the lever 177 contacts a left edge 164A of the opening 164 by being urged leftward by the spring 179, and also contacts a front edge 164B of the opening 164 by being urged in the circumferential direction by the spring 179. The position of the sliding member 171 at this time (the position shown in FIGS. 6C and 7A) is position A.

Figure 7B:
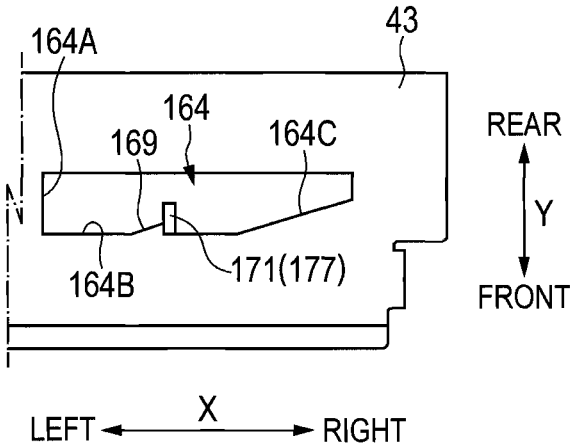

The lever 177 urged rightward by the carriage 23 moves rightward against the urging force of the spring 179. At this time, the lever 177 slides over a slanted edge of a protrusion 169. The main body 168 separated from the lever 177 also moves rightward by the urging force of the spring 178. Then, when the carriage 23 moves leftward, the lever 177 cannot slide over the protrusion 169 leftward due to the shape of the protrusion 169. Accordingly, as shown in FIG. 7B, the lever 177 engages with the protrusion 169 protruding rearward from the edge 164B. As a result, the switching mechanism 170 changes the state from the third driving state shown in FIG. 6C to the second driving state shown in FIG. 6B. The position of the sliding member 171 at this time (refer to FIGS. 6B and 7B) is position B. In other words, when the state of the switching mechanism 170 changes from the third driving state to the second driving state, the sliding member 171 moves from the position A to the position B.

Figure 7C:
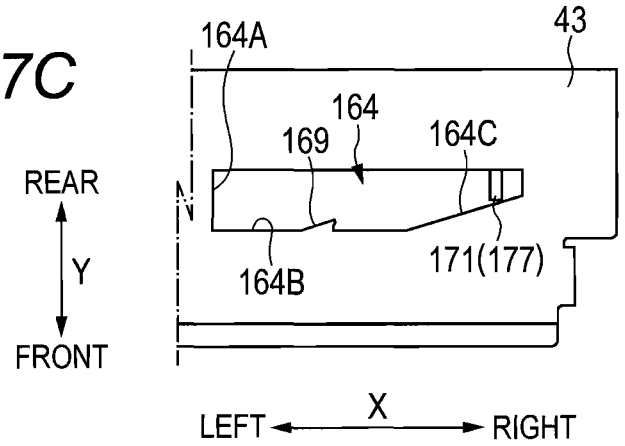

In the state shown in FIG. 6B, the lever 177 pushed rightward by the carriage 23 moves rightward against the urging force of the spring 179. Due to this, the main body 168 separated from the lever 177 moves rightward by the urging force of the spring 178. As a result, the state of the switching mechanism 170 changes from the second driving state shown in FIG. 6B to the first driving state shown in FIG. 6A. Note that, in the state change from the second driving state to the first driving state, as shown in FIG. 7C, the lever 177 is guided rearward along an inclined face 164C against the urging force of the spring 178 in the circumferential direction. The inclined face 164C is formed at the right side of the edge 164B. The position of the sliding member 171 at this time (refer to FIGS. 6A and 7C) is position C. In other words, when the state of the switching mechanism 170 changes from the second driving state to the first driving state, the sliding member 171 moves from the position B to the position C.

In the state shown in FIG. 6A, when the carriage 23 is separated from the lever 177 by the leftward movement of the carriage 23, the main body 168 and the lever 177 move leftward by the urging force of the spring 179. Here, as described above, the lever 177 is urged forward by the spring 179. However, there is a guide (not shown) that restricts the lever 177 from moving to a position where the lever 177 engages the protrusion 169. Thus, the lever 177 moves leftward without engaging with the protrusion 169. As a result, the state of the switching mechanism 170 changes from the first driving state shown in FIGS. 6A and 7C to the third driving state shown in FIGS. 6C and 7A. In other words, when the state of the switching mechanism 170 changes from the first driving state to the third driving state, the sliding member 171 moves from the position C to the position A.

As described above, when the carriage 23 separates from the lever 177, the state of the switching mechanism 170 changes in the following order: from the third driving state to the second driving state; from the second driving state to the first driving state; and from the first driving state to the third driving state. That is, the transmission destination of the driving force from the feeding motor 101 and the conveying motor 102 is switched by the carriage 23. In addition to this, with the state change of the switching mechanism 170, the sliding member 171 moves in the following order, that is, from the position A to the position B, from the position B to the position C, and from the position C to the position A.

[Controller 130]

As shown in FIG. 4, the controller 130 includes a CPU 131, a ROM 132, a RAM 133, an EEPROM 134, an ASIC 135, and a communication interface 136. These are connected to each other by an internal bus 137. The ROM 132 stores programs for the CPU 131 to control various operations and the like. The RAM 133 is used as a storage area for temporarily recording data and signals used when the CPU 131 executes the above programs or as a work area for data processing. The EEPROM 134 stores settings, flags, and the like to be held even after power-off. The RAM 133 and the EEPROM 134 are examples of the memory.

The ASIC 135 is connected to the feeding motor 101, the conveying motor 102, the carriage motor 103, the lamp 19, and so on. The ASIC 135 generates drive signals for rotating each motor, and controls those motors based on the drive signals. Each motor rotates forwardly or reversely by the drive signals from the ASIC 135. For example, the controller 130 controls driving of the feeding motor 101 to rotate each feeding roller 25, 35 and to drive the cam mechanism 112. The controller 130 also controls the drive of the conveying motor 102 to rotate each roller 60, 62 and to drive the pump 113. Moreover, the controller 130 controls the drive of the carriage motor 103 to move the carriage 23 in a reciprocating manner. Further, the controller 130 turns on the lamp 19 when the power of the MFP 10 is on (an example of the first state) and turn off the lamp 19 when the power of the MFP 10 is off. Further, the controller 130 also controls the lamp 19 to blink (the second state) depending on the state of the apparatus.

In addition, the controller 130 controls the recording head 39 to eject ink droplets from the nozzles 40. Specifically, a driving voltage is applied selectively from a head control board (not shown) provided in the recording head 39 to piezoelectric elements (not shown) provided corresponding to the respective nozzles 40. Accordingly, ink droplets are selectively ejected from the nozzles 40.

The ASIC 135 is also provided with a timer circuit for counting elapsed time. Counting the elapsed time may also be performed by time counting programs that stored in the ROM 132 or the like. The timer circuit will be described later in detail.

The ASIC 135 is connected to the optical sensor 51 of the linear encoder 52. The CPU 131 calculates the position of the carriage 23 based on the detected signals transmitted from the optical sensor 51. More specifically, the controller 130 determines the original position of the carriage 23 by moving the carriage 23 so that the carriage 23 contacts a frame (not shown) provided at the right side or left side of the first conveying path 65. Then, the controller 130 calculates the position of the carriage 23 by calculating the moving amount of the carriage 23 from the original position, based on the detected signals from the optical sensor 51.

Moreover, the ASIC 135 is connected to the optical sensor 126. The controller 130 detects the downstream end and the upstream end of the sheet 12 in the conveying direction 16 at the position where the detector 123 is arranged, based on the signals from the optical sensor 126.

The communication interface 136 is configured to perform data communication with an information processing apparatus 140 such as a personal computer. For example, the communication interface 136 is configured to perform communication with the information processing apparatus 140 by communication methods including wired LAN communication, wireless LAN communication, USB communication, or Bluetooth™ communication. The communication interface 136, as described below, receives a preceding command (an example of the first information) transmitted from the information processing apparatus 140 and then receives the printing data (an example of the second information) transmitted from the information processing apparatus 140.

[Information Processing Apparatus 140]

As shown in FIG. 4, the information processing apparatus 140 includes a controller 141 having a CPU and a RAM, a storage 142, an operating interface 143, a display 144, and a communication interface 145. The controller 141 integrally controls each section of the information processing apparatus 140.

The storage 142 may be a hard disk drive. The storage 142 stores various programs to be performed by the controller 141. For example, the programs include application programs such as a word processer, and a printer driver.

The operating interface 143 may be a key board and a mouse. By the user's operation, operation signals are inputted to the operating interface 143. The operation signals are transmitted to the controller 141. The display 144 may be a liquid-crystal display, for example.

The communication interface 145 is configured to perform data communication with the MFP 10. When controlled by the controller 141, as described below, the communication interface 145 transmits a preceding command to the MFP 10 and then transmits printing data to the MFP 10.

[Processing by Controller 141 of Information Processing Apparatus 140]

Figure 8:
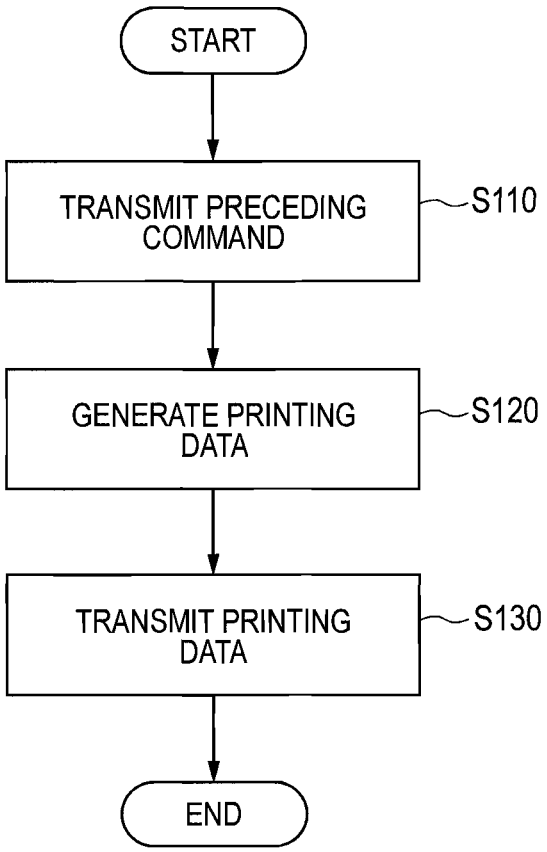
FIG. 8 is a flow chart illustrating processes performed by a controller 141 of the information processing apparatus 140 at a time of printing on a sheet 12.

Hereinafter, a process performed by the controller 141 at the printing on the sheet 12 will be described with reference to the flowchart shown in FIG. 8. When a print instruction is inputted by a user (an image recording instruction) through an application program, the controller 141 performs the processing shown in FIG. 8.

When the print instruction is inputted, the controller 141 transmits a preceding command to a printing apparatus designated by a user (the MFP 10 in the present embodiment) (S110). The preceding command is data for indicating start of image recording; in other words, it is data for indicating a preparing operation. The preparing operation at least includes a process to move the cap 114 from the covered position to the separated position. The operation may include other processing such as flushing. For instance, when the MFP 10 has a lock mechanism for locking the carriage 23 at the second region, the preparing operation may include a release operation of the locking state of the carriage 23.

Next, the controller 141 converts document data and/or image data of the print target designated by a user into printing data for printing on the sheet 12 under conditions specified by the user (S120). For example, the printing data is data obtained by expressing document data and image data by a page description language. At the beginning of the printing data, image recording conditions are described. For example, the image recording conditions include: a tray that supports the sheet 12 to be fed, i.e. the target tray (the first feeding tray 20 or the second feeding tray 22 in the present embodiment); the size of the sheet 12; the number of sheets to be printed; and special printing (for example, enlargement printing, reduction printing, the number of pages to be printed on one face of the sheet 12).

Next, the controller 141 sequentially transmits the printing data for which conversion is finished, to the MFP 10 (specifically, the communication interface 136 of the MFP 10) (S130). The printing data is generated for each data of an image unit that is formed on the sheet 12 by one-way movement of the carriage 23 in the left-right direction X (hereinafter, refer to as "printing data by one path"), and then transmitted sequentially.

[Processing by Controller 130 of MFP 10]

Hereinafter, a process performed by the controller 130 during printing on the sheet 12 will be described with reference to the flowchart of FIG. 9 and the timing chart of FIG. 10.

Each process is performed by the CPU 131 of the controller 130. Each of the following processes may be performed by CPU131 that retrieves a program stored in the ROM 132 and carries out the program or may be performed by a hardware circuit mounted on the controller 130. Note that, at the initial state, the carriage 23 is located in the second region.

The controller 130 waits until a preceding command is received from the information processing apparatus 140 (S210: No). When the controller 130 receives the preceding command (S210: Yes), the controller 130 controls the lighted lamp 19 to start blinking (S215), then determines whether the position of the cap 114 is the separated position or the covered position (S220). In the present embodiment, the lamp 19 repeats turning on and off alternately every 350 milliseconds.

The position of the cap 114 is determined, for example, based on the output signals of a sensor configured to output different signals depending on the position of the cap 114. The method for determining the position of the cap 114 is not limited to the above-mentioned method that uses a sensor. For example, in a case where the capping mechanism 115 is configured in such a manner that the cap 114 moves from the separated position to the covered position when the capping mechanism 115 is pressed by the carriage 23 that moves rightward, and that the cap 114 moves from the covered position to the separated position when the carriage 23 moves leftward and separates from the capping mechanism 115, the controller 130 may determine the position of the cap 114 based on the position of the carriage 23 calculated based on the output signals from the optical sensor 51 of the linear encoder 52.

When the cap 114 is located at the covered position (S220: No), the controller 130 performs the preparing operation in accordance with the preceding command. In other words, the controller 130 moves the cap 114 from the covered position to the separated position (S230).

In the step S230, the controller 130 controls the carriage 23 rightward to move the sliding member 171 to the position C so that the switching mechanism 170 is in the first driving state (refer to FIGS. 6A and 7C), thereby obtaining a state where the switching mechanism 170 transmits the driving force of the feeding motor 101 to the cam mechanism 112. And, when the feeding motor 101 is driven to operate the cam mechanism 112, the cap 114 moves downward from the covered position to the separated position.

When the cap 114 is located at the separated position, the controller 130 determines the current position of the sliding member 171 (S260). In the present embodiment, information regarding the position of the sliding member 171 is stored in the RAM 133. Specifically, each time the controller 130 controls the carriage 23 in order to move the sliding member 171, the controller 130 stores, in the RAM 133, the information about the instructed destination of the sliding member 171 as the positional information of the sliding member 171. The method for determining the current position of the sliding member 171 is not limited to the above-mentioned method. For example, a sensor may be provided in order for detecting the position of the sliding member 171. In this case, the positional information of the sliding member 171 corresponding to the output signals from the sensor is stored in the RAM 133.

When the sliding member 171 is at the position A (S260: Yes), the controller 130 performs flushing (S240). In 5240, the controller 130 moves the carriage 23 leftward from the second region to the third region via the first region. With this operation, the carriage 23 faces the ink receiving section 119. In this state, the controller 130 controls the recording head 39 so as to eject ink droplets from nozzles 40.

On the other hand, when the sliding member 171 is not at the position A, in other words, the sliding member 171 is at the position B or the position C (S260: No), the controller 130 controls the carriage 23 so as to move the sliding member 171 to the position A (S270). This movement is an example of the switching operation. Subsequently, in the same manner as the above description, the controller 130 performs flushing (S240).

As described above, the sliding member 171 moves in the following order, that is, from the position A to the position B, from the position B to the position C, and from the position C to the position A. In other words, when the sliding member 171 is at the position C, the controller 130 controls the carriage 23 to move leftward and separate from the lever 177 of the sliding member 171, thereby moving the sliding member 171 from the position C to the position A by the urging force of the spring 179. On the other hand, when the sliding member 171 is at the position B, the controller 130 controls the carriage 23 to move rightward and press the lever 177, thereby moving the sliding member 171 from the position B to the position C temporarily. Subsequently, the controller 130 controls the carriage 23 to move leftward, thereby moving the sliding member 171 from the position C to the position A.

Further, after moving the sliding member 171 to the desired position, the controller 130 controls the conveying motor 102 to drive forward and reverse alternately by small amounts in a repeated manner, in order to move the drive gears 172, 173 in the left-right direction X by the urging force of the springs 178, 179 and to allow the drive gears 172, 173 to engage with the predetermined driven gears 165, 166, 167, 191. This driving of the conveying motor 102 releases surface pressure between the drive gears 172, 173 and the driven gears 165, 166, 167, 191 engaging with the drive gears 172, 173. Further, due to this driving of the conveying motor 102, the drive gears 172, 173 and the driven gears 165, 166, 167, 191 become engaging positions, so that the drive gears 172, 173 can pass or engage with the desired driven gears 165, 166, 167, 191. After driving the conveying motor 102 forward and reverse alternately by small amounts in this way, the conveying motor 102 can be driven as described later.

Moreover, the controller 130 applies driving voltages to the piezoelectric elements (not shown) provided corresponding to respective nozzles 40 (S280). As a result, the voltage of the recording head 39 increases. The application of driving voltages to the flushing and the piezoelectric elements is not necessarily performed during the preparing operation. The volume of the operating sound in each mechanism from S230 to S280 is relatively small (that is, smaller than the sound of the conveying roller 60 and the discharging roller 62).

After the preparing operation is completed, when the controller 130 does not receive printing data of a first one path portion from the information processing apparatus 140 (S290: No), the controller 130 performs a driving operation. Specifically, the controller 130 controls the conveying motor 102 to forwardly rotate so that the conveying roller 60 and the discharging roller 62 forwardly rotate (S250). In the driving operation, the controller 130 perform control such that the rotational speed of the conveying motor 102 is lower than the rotational speed of the conveying motor 102 that conveys the sheet 12 in the conveying operation during a printing process described below (S310). The timing for conveying the sheet 12 in the conveying operation during the printing process (S310) is roughly classified into: (1) cueing conveyance of conveying the sheet 12 to a position where a recording start portion of the sheet 12 is located under the recording head 39, after the sheet 12 is fed from the first feeding tray 20 or the second feeding tray 22; (2) intermittent conveyance of repeating conveying the sheet 12 by a conveyance amount equivalent to a one path portion, for example, and then stopping when recording an image on the sheet 12; (3) discharge conveyance of discharging the sheet 12 on which image recording has been completed; and so on. In the driving operation, the controller 130 performs control such that the rotational speed of the conveying motor 102 is lower than the rotational speed of the conveying motor 102 at the timing when the sheet 12 is conveyed at the lowest speed among the above-mentioned conveyance operations (1) to (3) and so on.

When the controller 130 receives the printing data of the first one path portion (S290: Yes), the controller 130 determines the target tray based on the image recording condition included in the printing data (S300). If the target tray is the first feeding tray 20 (S300: Yes), the controller 130 controls the feeding motor 101 to start a feeding operation for feeding the sheet 12 supported by the first feeding tray 20 to the first conveying path 65 (S330).

Then, when the controller 130 receives the printing data of the first one path portion, the controller 130 stops forward driving of the conveying motor 102 before the sheet 12, which is fed from the first feeding tray 20 to the first conveying path 65 by the feeding operation, reaches the conveying roller 60 (S340). Specifically, when the controller 130 receives the printing data of the first one path portion, the controller 130 controls the conveying motor 102 to decelerate and then to stop forward driving. The timing to stop the forward driving of the conveying motor 102 may be, for example, as follows. That is, feeding time required for the sheet 12 to reach the conveying roller 60 is calculated in advance, based on relationship between the rotational speed of the first feeding roller 25 and the distance from the first feeding tray 20 to the conveying roller 60 through the first conveying path 65. Then, predetermined time shorter than the calculated feeding time is stored in the ROM 132 or the like. In an image recording operation, the forward driving of the conveying motor 102 is decelerated at the timing when the predetermined time elapses from the timing when the feeding motor 101 starts driving (refer to FIG. 10). For example, in the present embodiment where the leading end of the sheet 12 abuts the stopped conveying roller 60 for correcting the skew, the predetermined time is preferably shorter than the time obtained by subtracting, from the feeding time, the time required for decelerating and stopping the forwardly-driving conveying motor 102 (here, the desired operation of the conveying motor 102 is "decelerating and stopping the forwardly-driving conveying motor 102"). In another embodiment where the leading end of the sheet 12 abuts the reversely-driving conveying roller 60 for correcting the skew of the sheet 12, the predetermined time is preferably shorter than the time obtained by subtracting, from the feeding time, the time required for decelerating and stopping the forwardly-driving conveying motor 102 and for driving the conveying motor 102 to rotate reversely (here, the desired operation of the conveying motor 102 is "decelerating and stopping the forwardly-driving conveying motor 102 and then driving the conveying motor 102 to rotate reversely").

Next, the controller 130 controls the conveying motor 102 and the conveying section 54 to convey the fed sheet 12 in the conveying direction 16, and to convey the sheet 12 to a position at which the recording start portion of the sheet 12 corresponds to the nozzle 40 at the most upstream position in the conveying direction 14 (hereinafter, this operation is referred to as "convey sheet to recording start position" or "conveyance to recording start position") (S350). The controller 130 having started the conveyance to the recording start position finishes blinking of the lamp 19 and switches to the lighting state (S355).

The controller 130 having completed the conveyance to the recording start position performs the printing process (S310). During the printing process, the controller 130 controls the conveying motor 102, the carriage motor 103, and the recording head 39 to print, on the sheet 12, an image corresponding to one path portion of the printing data that is sent sequentially. The controller 130 alternately performs conveyance of the sheet 12 for one line, one-way movement of the carriage 23, and ejection of ink droplets by the recording head 39 so that an image is recorded on the sheet 12.

On the other hand, when the target tray is the second feeding tray 22 (S300: No), the controller 130 controls the carriage 23 to move the sliding member 171 from the position A to the position B (S320). Due to this operation, transmission destination of the feeding motor 101 is switched to the second feeding section 34. Then, in the same manner as above, the controller 130 performs the feeding operation, stoppage of the conveying motor 102, the conveyance to the recording start position, and the printing process (S310).

Figure 9:
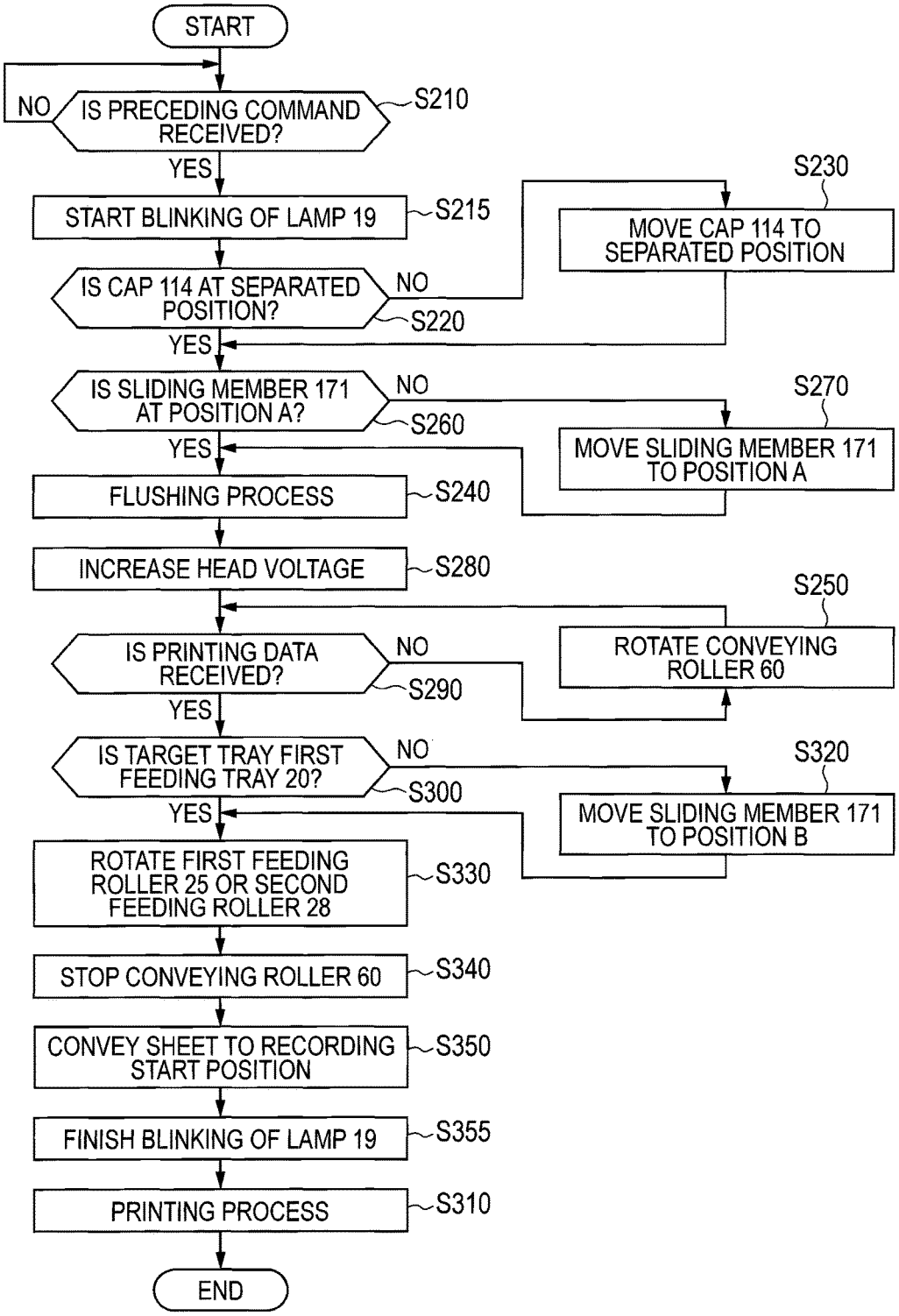
FIG. 9 is a flow chart illustrating processes performed by a controller 130 of the MFP 10 at a time of printing on the sheet 12.
Figure 10:
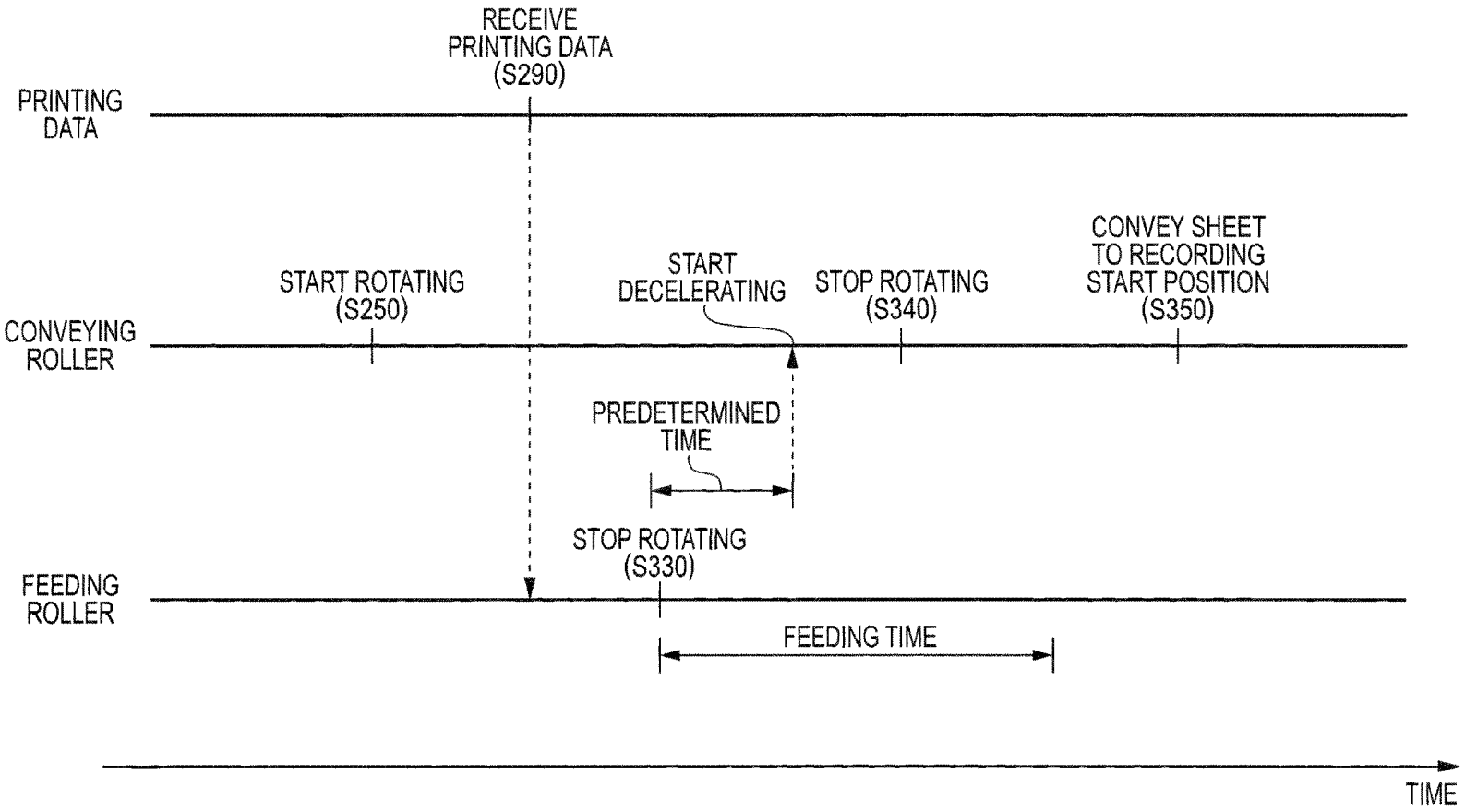
FIG. 10 is a timing chart showing timing of driving of a conveying roller and a feeding roller.

Although not shown in FIG. 9, the controller 130 controls the cap 114 to move from the separated position to the covered position after predetermined time elapses from the completion of the printing process. Thus, the controller 130 controls the carriage 23 to move to the second region before the caps 114 moves to the covered position after the print completion. As a result, due to contact of the carriage 23 with the sliding member 171, the sliding member 171 moves to the position C and the switching mechanism 170 shifts to the first driving state (refer to FIGS. 6A and 7C), and the driving force of the feeding motor 101 is transmitted to the cam mechanism 112.

Moreover, at the time of printing, the controller 130 applies the driving voltage to the piezoelectric elements (not shown) provided corresponding to the respective nozzles 40 so that the voltage of the recording head 39 increases (S280). Although the driving voltage is kept applied to the recording head 39 during printing, the driving voltage is decreased to zero by the controller 130 when the above-mentioned predetermined time elapses after the print completion.

[Effects of the Embodiment]

According to the present embodiment, the controller 130 receives the preceding command and performs the preparing operation. Thus, the preparing operation can be finished by using time for receiving printing data after receiving the preceding command. If the printing data has not been received even after the preparing operation is finished, the controller 130 performs the driving operation. The controller 130 receives printing data, stops the conveying motor 102, and performs the feeding operation. Because the driving operation is performed, the MFP 10 does not stop and become a silent state during a period after the preparing operation is finished and before the feeding operation is performed. Thus, in the preparation time before the printing process is started in the MFP 10, uneasiness of the user (for example, the user feels as if the MFP 10 has stopped its operation) is reliably alleviated.

Further, the controller 130 stops the conveying motor 102 after the feeding operation is started, on condition that printing data is received. Thus, no silent state is created between the driving operation and the feeding operation.

Moreover, the controller 130 stops the conveying motor 102 before the sheet 12 fed by the feeding operation reaches the conveying roller 60. Thus, the skew of the sheet 12 can be corrected by allowing the sheet 12 fed into the first conveying path 65 or the second conveying path 66 by the feeding operation to abut on the conveying roller 60 in a stopped state or a reversed state.

Moreover, the controller 130 rotates the conveying roller 60 in the conveying direction 16 during the driving operation. Thus, the sheet 12 remaining in the first conveying path 65 after printing can be conveyed in the conveying direction 16 by the conveying roller 60 or the discharging roller 62.

Moreover, before performing the driving operation, the controller 130 performs the switching operation of switching the position of the sliding member 171 in the switching mechanism 170 from the position C to the position A. Thus, transmission of the driving force from the conveying motor 102 to the pump 113 of the maintenance mechanism 110 is cut off before the feeding operation is performed. And, driving force is transmitted from the feeding motor 101 to the first feeding roller 25. Hence, an engagement state of gears in the switching mechanism 170 and so on is stabilized.

Further, the controller 130 performs control such that the rotational speed of the conveying motor 102 in the driving operation is lower than the rotational speed of the conveying motor 102 in the conveying operation. Thus, it is possible to shorten the time before stoppage of the conveying motor 102 when the driving operation is finished.

Further, the controller 130 controls the cap 114 to move from the covered position to the separated position in the preparing operation. Thus, it is possible to shorten the time required from when start of image recording is instructed by the preceding command to when image recording based on printing data is completed.

Further, the controller 130 controls the lighting lamp 19 to blink, on condition that the preceding command is received. Thus, the user can be notified that the apparatus is operating at an earlier timing than the conveying motor 102 is driven forwardly and the conveying roller 60 rotates. Moreover, the controller 130 controls the lamp 19 to keep blinking until the timing when the conveying motor 102 is driven forwardly and the conveying roller 60 starts the conveyance to the recording start position. Thus, after printing data is received, there is no state where the lamp 19 is not blinking and where none of the conveying roller 60, the first feeding roller 25, and the second feeding roller 28 is driven. In other words, after the controller 130 receives printing data, the MFP 10 does not become a state where the lamp 19 is not blinking and where the apparatus is in a silent state.

[Modifications]

While the disclosure has been described in detail with reference to the above aspects thereof, it would be apparent to those skilled in the art that various changes and modifications may be made therein without departing from the scope of the claims.

In the above-described embodiment, the switching mechanism 170 switches on and off the transmission of the driving force from the conveying motor 102 to the pump 113 of the maintenance mechanism 110. However, the switching mechanism 170 may be another configuration that switches the transmission of the driving force of the conveying motor 102 to another driven mechanism such as a roller other than the conveying roller 60 and the discharging roller 62.

Further, in the above-described driving operation, a driven mechanism other than the conveying roller 60 may be driven. For example, a roller provided in an automatic document feeder (ADF) of the scanner 18 may be driven, instead of the conveying roller 60. In this case, too, the roller and so on of the automatic document feeder is stopped after the first feeding roller 25 is driven, so that the driving sound is continuous.

Further, the driven mechanism may be the first feeding roller 25 of the first feeding tray 20 or the second feeding roller 28 of the second feeding tray 22 when there is no sheet in that tray 20 or 22. Further, the driven mechanism may be a scanning member of the scanner 18. Or, in an image forming apparatus having a sheet feeding tray at the rear side of the apparatus, the driven mechanism may be such sheet feeding tray. Or, in an image forming apparatus in which, for example, a sheet discharging tray or an operation panel is moved by a motor, the driven mechanism may be a mechanism that moves such sheet discharging tray or operation panel.

In the above-described embodiment, the controller 130 controls the conveying motor 102 to drive forwardly in the driving operation. However, the controller 130 may control the conveying motor 102 to drive reversely. In other words, the conveying roller 60 may be driven in the opposite direction to the sheet conveying direction 16. Further, the rotational speed of the conveying roller 60 in the driving operation may be the same as or faster than the rotational speed of the conveying roller 60 in the image recording operation.

In the above-described embodiment, the preparing operation includes: an operation moving the cap 114 from the covered position to the separated position (S230); an operation of ejecting, from the recording head 39, ink droplets from each of the nozzles 40 (S240); an operation of moving the sliding member 171 to the position A (S270); and an operation of applying the driving voltage to the piezoelectric elements of the recording head 39 (S280). However, the preparing operation is not limited to these.

The preparing operation may be any one of operations in the apparatus that can be performed before printing data reaches the controller 130.

In the above-described embodiment, the MFP 10 has two feeding trays (that is, the first feeding tray 20 and the second feeding tray 22). However, the MFP 10 may have only one feeding tray, or may have three or more feeding trays. In this case, the feeding section is provided so as to correspond to each feeding tray.

What is claimed is:

1. An image recording apparatus comprising:

a first motor;

a feeding roller configured to rotate by receiving driving force from the first motor;

a second motor;

a first driven roller arrangement configured to be driven by receiving driving force from the second motor;

a recorder; and a controller configured to:

perform a preparing operation in response to receiving first information from an information processing apparatus, the first information instructing starting image recording by the recorder;

after the preparing operation is completed, determining whether second information including a recording condition and printing data is received from the information processing apparatus;

in response to determining that the second information is not received after the preparing operation is completed, perform a driving operation of driving the second motor to drive the driven roller arrangement; and in response to receiving the second information, stop the second motor and drive the first motor to perform a feeding operation by the feeding roller.

2. The image recording apparatus according to claim 1, wherein the controller is configured to, in response to receiving the second information:

start the feeding operation; and stop the second motor after starting the feeding operation.

3. The image recording apparatus according to claim 2, wherein the first driven roller arrangement comprises a first conveying roller configured to convey a sheet fed by the feeding roller in a conveying direction; and wherein the controller is configured to stop the second motor before the sheet fed by the feeding operation reaches the first conveying roller.

4. The image recording apparatus according to claim 3, wherein the controller is configured to, in the driving operation, drive the second motor to rotate the first conveying roller in a rotational direction by which the sheet is conveyed in the conveying direction.

5. The image recording apparatus according to claim 3, wherein the first driven roller arrangement further comprises a second conveying roller located downstream of the first conveying roller in the conveying direction; and wherein the second motor is configured to transmit the driving force to the first conveying roller and the second conveying roller.

6. The image recording apparatus according to claim 3, further comprising:

a second driven mechanism configured to be driven by receiving driving force from the second motor; and a switching mechanism configured to switch transmission and disconnection of the driving force of the second motor to at least the second driven roller arrangement; and wherein the controller is configured to, before performing the driving operation, control the switching mechanism to perform a switching operation of disconnecting transmission of the driving force of the second motor to the second driven roller arrangement.

7. The image recording apparatus according to claim 3, wherein the controller is configured to, after performing the feeding operation, perform a conveying operation of driving the second motor to rotate the first conveying roller and to convey the sheet; and wherein a rotational speed of the second motor in the driving operation is lower than a rotational speed of the second motor in the conveying operation.

8. The image recording apparatus according to claim 3, further comprising a feeding tray configured to support the sheet, wherein the feeding roller is configured to feed the sheet supported by the feeding tray to the first conveying roller; and wherein the controller is configured to decelerate the second motor at timing when predetermined time elapses from timing when the first motor starts driving, the predetermined time being shorter than time obtained by subtracting, from feeding time, time required for decelerating and stopping the second motor, the feeding time being time required for the sheet to be conveyed from the feeding tray to the first conveying roller.

9. The image recording apparatus according to claim 3, further comprising a feeding tray configured to support the sheet, wherein the feeding roller is configured to feed the sheet supported by the feeding tray to the first conveying roller; and wherein the controller is configured to decelerate the second motor at timing when predetermined time elapses from timing when the first motor starts driving, the predetermined time being shorter than time obtained by subtracting, from feeding time, time required for decelerating and stopping the forwardly-driving second motor and for driving the second motor to rotate reversely, the feeding time being time required for the sheet to be conveyed from the feeding tray to the first conveying roller.

10. The image recording apparatus according to claim 1, further comprising:

a lamp configured to notify an operating state of the image recording apparatus, wherein the controller is configured to:

in response to receiving the first information, change a lighting state of the lamp from a first state to a second state; and after stopping the second motor, change the lighting state from the second state to the first state.

11. The image recording apparatus according to claim 1, wherein the recorder comprises:

a recording head configured to selectively eject ink from nozzles, the recording head having a nozzle surface in which the nozzles are formed; and a cap configured to move between a first position at which the cap covers the nozzle surface and a second position at which the cap is separated from the nozzle surface; and wherein the controller is configured to move the cap from the first position to the second position in the preparing operation.

12. The image recording apparatus according to claim 1, wherein the first driven roller arrangement comprises a roller configured to be driven by receiving the driving force from the second motor.

13. The image recording apparatus according to claim 1, wherein the first information is a preceding command that does not include the printing data.

* * * * *